US008154365B2

(12) United States Patent
Chan et al.

(10) Patent No.: US 8,154,365 B2
(45) Date of Patent: Apr. 10, 2012

(54) MEMS SWITCHING DEVICE PROTECTION

(75) Inventors: Cammen Chan, Phoenix, AZ (US); Geoffrey T. Haigh, Boxford, MA (US)

(73) Assignee: Analog Devices, Inc., Norwood, MA (US)

( * ) Notice: Subject to any disclaimer, the term of this patent is extended or adjusted under 35 U.S.C. 154(b) by 5 days.

(21) Appl. No.: 12/814,750

(22) Filed: Jun. 14, 2010

(65) Prior Publication Data

US 2010/0254062 A1 Oct. 7, 2010

Related U.S. Application Data

(63) Continuation of application No. 11/482,179, filed on Jul. 6, 2006, now Pat. No. 7,737,810.

(60) Provisional application No. 60/697,661, filed on Jul. 8, 2005.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,959,746 | A | 9/1990 | Hongel | |
| 6,054,659 | A * | 4/2000 | Lee et al. | 200/181 |
| 6,798,321 | B2 | 9/2004 | Hallbjorner | 335/78 |
| 6,884,950 | B1 | 4/2005 | Nicholson et al. | 200/181 |
| 7,155,979 | B2 * | 1/2007 | Lasalandra et al. | 73/514.18 |
| 2004/0113713 | A1 | 6/2004 | Zipper et al. | 333/103 |
| 2006/0269186 | A1 | 11/2006 | Frame et al. | 385/12 |
| 2007/0139145 | A1 * | 6/2007 | Subramanian et al. | 335/78 |
| 2008/0007888 | A1 | 1/2008 | Morris, III et al. | 361/281 |
| 2008/0093685 | A1 | 4/2008 | Watanabe et al. | 257/415 |

FOREIGN PATENT DOCUMENTS

WO WO 99/19974 4/1999

OTHER PUBLICATIONS

International Search Report; dated Dec. 4, 2006; received Dec. 8, 2006; PCT/US2006/026230.

* cited by examiner

*Primary Examiner* — Bernard Rojas

(74) *Attorney, Agent, or Firm* — Sunstein Kann Murphy & Timbers LLP

(57) ABSTRACT

A micro-machined switching system for equalizing an electrical property, such as charge due to parasitic capacitance formed at an input and an output of a micro-machined switching device. The micro-machined switching device may be a MEMS relay or a MEMS switch. In addition to the micro-machined switching device, the switching system also includes a balancing module for equalizing the electrical property between the input and the output of the micro-machined switching device. In certain embodiments, the balancing module includes a switch operable in a first state causing charge due to the parasitic capacitance on the input and the output of the micro-machined switching device to substantially balance. The switch is also operable in a second state wherein parasitic capacitance can separately accumulate at the input and the output of the micro-machined switching device.

19 Claims, 7 Drawing Sheets

MEMS SWITCHING DEVICE PROTECTION

CROSS REFERENCE TO RELATED APPLICATIONS

The following application is a U.S. Continuation Patent Application of and claims priority from U.S. patent application Ser. No. 11/482,179 filed on Jul. 6, 2006, entitled "MEMS Switching Device Protection", which itself claims priority from U.S. Provisional Patent Application Ser. No. 60/697,661, entitled "Shunt Protection Circuit for a Micro-Machined Relay" filed on Jul. 8, 2005 all of which are incorporated herein by reference in their entirety.

TECHNICAL FIELD AND BACKGROUND ART

The present invention relates to MEMS switches/relays and more specifically to systems for extending the life of MEMS switches/relays.

Micro-machined (MEMS) relays are known in the art and can be used for creating a near ideal switch that has a plurality of states. MEMS relays 100 include a cantilevered beam 101 that bends as the result of electrostatic forces due to the presence of a voltage 105 at the gate 102 of the MEMS relay 100 as shown in FIG. 1. Thus, when the beam bends, an electrically conductive portion 106 of the underside of the beam completes a circuit path between a first portion of the signal path 103 and the second portion of the signal path 104. Although, MEMS relays produce near ideal switches, because of their small size, MEMS relays are sensitive to charge. During a state-change, as the result of parasitic capacitances, a differential voltage between the input and the output of the MEMS relays can result in large current flowing through the MEMS switch. As the beam of the MEMS relay completes the signal path, the resulting current can cause pitting of the beam and potentially weld the beam in a closed position. Thus, the imbalance in charge at the input and output of the MEMS relay will greatly reduce the number of potential cycles of use and will eventually lead to the relay's failure. Similarly, three terminal MEMS switches suffer from the same problem.

In addition to parasitic capacitance discharge, the life of a MEMS switch/relay is also greatly reduced as the result of "hot-switching." Hot-switching occurs when a signal is driven along the signal path while the MEMS switch/relay is changing states. As the beam of the MEMS switch/relay deflects and comes partially into contact with the signal path sections, the driven signal can cause a large current surge and arching. This surge in current can damage the beam of the MEMS switch/relay and cause switch failure.

SUMMARY OF THE INVENTION

In a first embodiment, the invention is a micro-machined switching system for equalizing an electrical property, such as charge due to parasitic capacitance formed at an input and an output of a micro-machined switching device. The micro-machined switching device may be a MEMS relay or a MEMS switch. In addition to the micro-machined switching device, the switching system also includes a balancing module for equalizing the electrical property between the input and the output of the micro-machined switching device. In certain embodiments, the balancing module includes a switch operable in a first state causing charge due to the parasitic capacitance on the input and the output of the micro-machined switching device to substantially balance. The switch is also operable in a second state wherein parasitic capacitance can separately accumulate at the input and the output of the micro-machined switching device. The balancing module of the micro-machined switching system can be built from bi-directional DMOS circuitry.

The switching system may also include a signal driver and a switch controller. In such embodiments, the switching system prevents hot-switching. The signal driver precedes the micro-machined switching device. The switch controller includes an input for receiving a switching signal and an output for supplying a gate voltage to the micro-machined switching device. The switch controller can issue an inhibit signal to the signal driver prior to the switch controller supplying a gate voltage to the micro-machined switching device. In some embodiments, the inhibit signal activates the balancing module. In yet other embodiments, the signal driver sends an inhibit signal to the switch controller inhibiting the switch controller from supplying a gate voltage to the micro-machined switching device when the signal driver is outputting a signal.

In certain embodiments, the switching system including the micro-machined switching device, the balancing module and the switch controller are formed on a common substrate. In other embodiments, the signal driver is also formed on the common substrate with the other elements of the switching system.

The MEMS switching system may be controlled using the following methodology. The switching system receives a state-change signal from an outside source, such as a processor indicating that the MEMS switching device should change states. In response to the state-change signal, an inhibit signal is generated. The inhibit signal can be generated by the switch controller. The inhibit signal is sent to the signal driver and also to the balancing module. In response to receiving the inhibit signal, the balancing module substantially causes charge equalization between an input and output of the MEMS switching device. The state of the MEMS switching device is then changed. The state of the MEMS switch changes while the signal driver is inhibited. After the MEMS switching device has changed states, the inhibit signal is no longer transmitted and the signal driver can drive the data signal. The switch controller may include circuitry to create the inhibit signal as a pulse having a predetermined period. In one embodiment, the period of the inhibit signal is long enough so that charge is substantially balanced between the input and the output of the MEMS switching device.

The MEMS switching system may be used in a plurality of environments, including, but not limited to, automatic testing equipment, and cellular telephones.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

A "MEMS switching device" shall refer to both MEMS switches and relays. A MEMS switch is a three terminal device (like a FET) including a gate, source and a drain, wherein an actuation voltage is applied to the "gate" and is with respect to one of the switch terminals (the source). A MEMS relay is a four terminal device (conductive layer on the cantilevered beam, gate, first conductive path, and second conductive path wherein the actuation voltage is applied to the "gate" and is with respect to a conductive layer that is insulated and isolated from both terminals of the switched path. A "signal driver" shall be any device that forwards an electrical signal including active elements, inactive elements, and a combination of active and inactive elements.

MEMS switching devices have been used in many different applications including cell phones and automatic testing equipment. The MEMS switching devices need to change states over many cycles often in the hundreds of millions to billions of cycles in order to be considered reliable for commercial use. Both hot switching of the MEMS switching device and parasitic capacitance imbalances between the input and the output of the MEMS switching device during switching can lead to an expected life that is less than acceptable for commercial use. As embodied, the following invention discloses circuitry and methodology for substantially eliminating hot-switching and parasitic capacitance discharges in MEMS switching devices.

Figure 1:
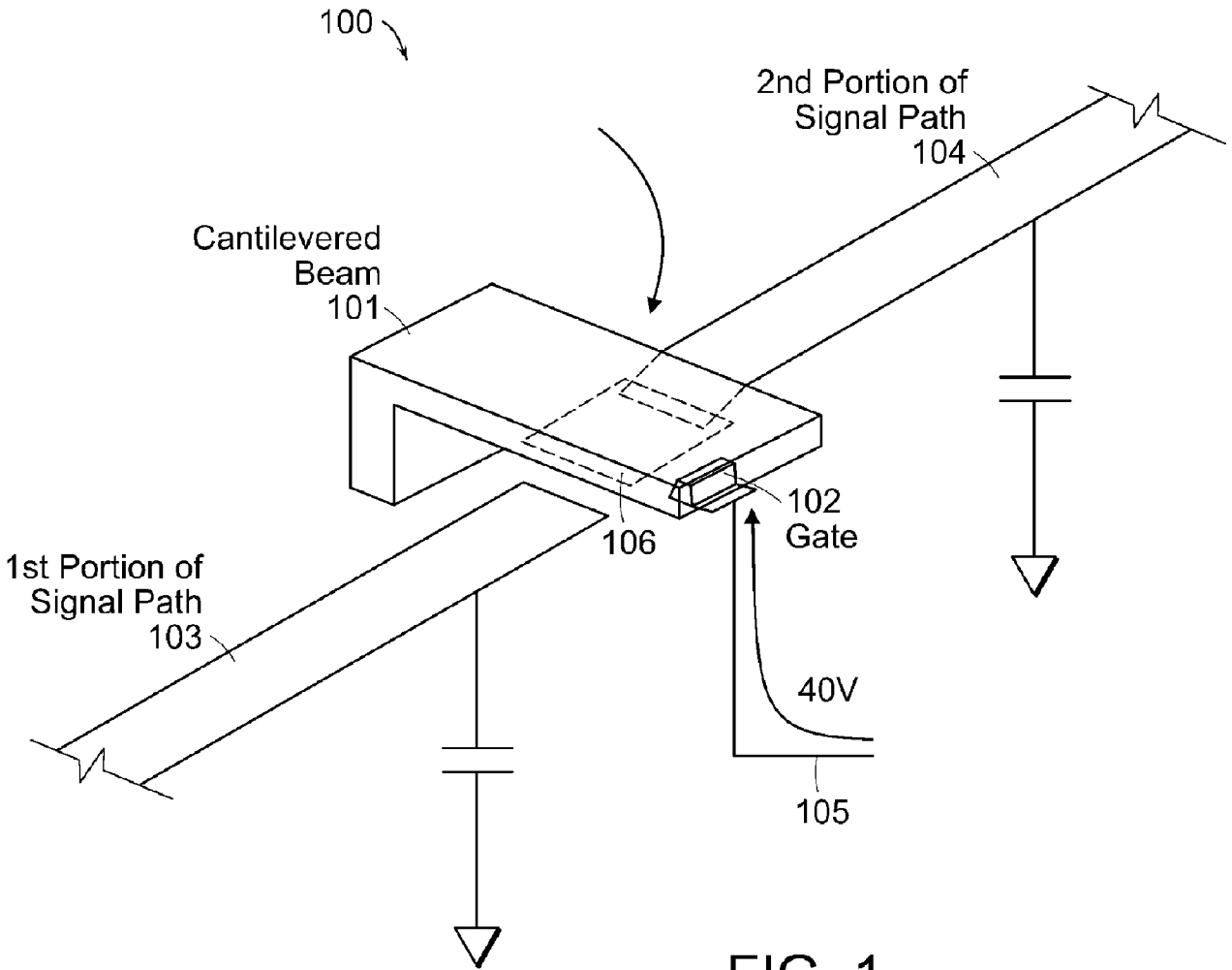
FIG. 1 shows a MEMS switching device.
Figure 2:
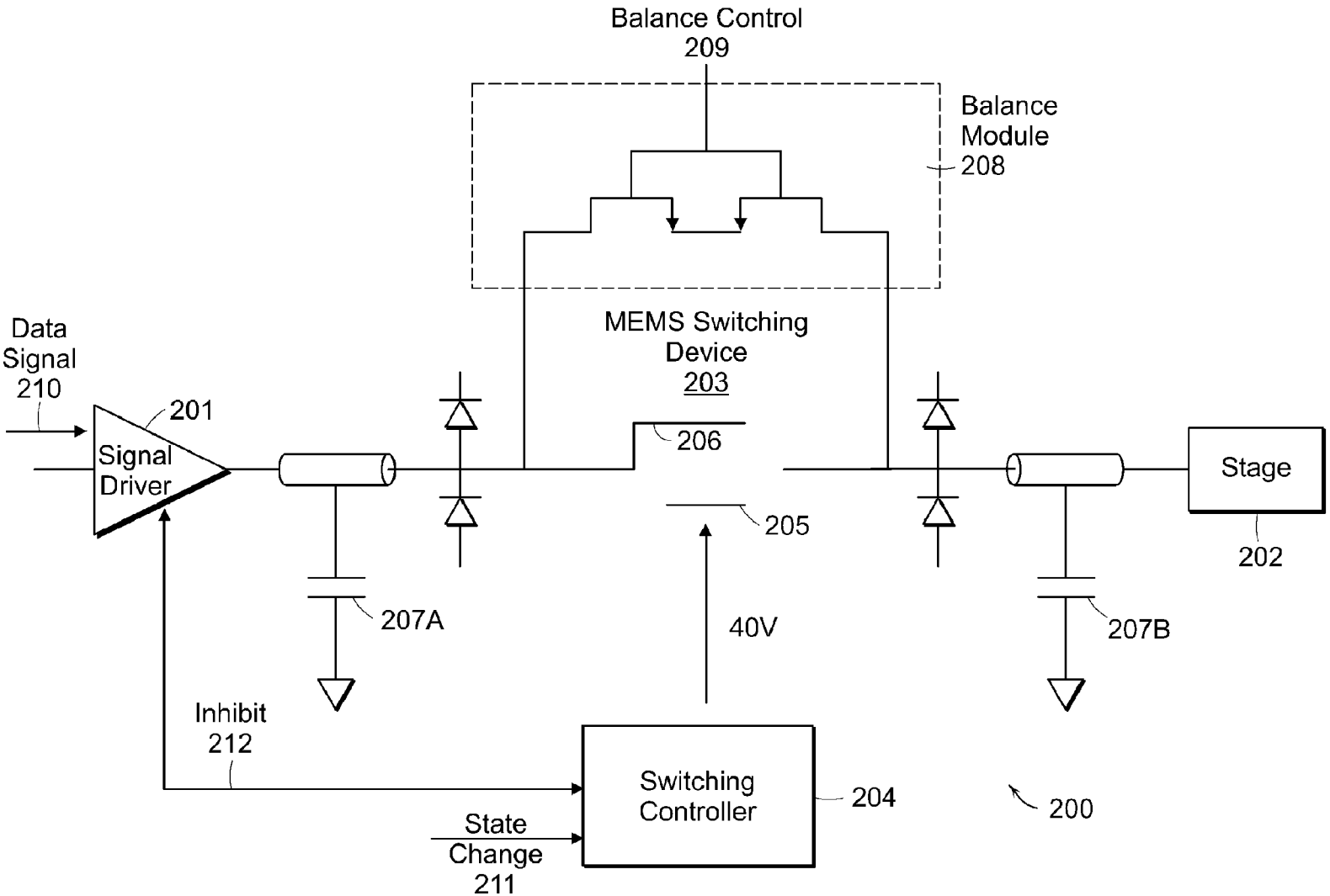
FIG. 2 is a circuit schematic showing a first embodiment of a MEMS switching system.

FIG. 2 is a circuit schematic showing a first embodiment of a MEMS switching system 200. The switching system can be formed on a shared-substrate with other electronic circuitry or the MEMS switching system may be formed on a separate integrated circuit. In the switching system, a signal driver 201 is coupled to a subsequent electronic stage 202 or output through a MEMS switching device 203. The signal driver 201 may be formed on the same substrate as the MEMS switching device and the MEMS switch controller 204, or the signal driver 201 may be formed on a separate substrate and electrically coupled to the switch controller 204 and MEMS switching device 203. The MEMS switching system 200 receives a state-change signal from outside of the switching system, (i.e. from a processor) to change the state of the MEMS switching device 203. The switch controller 204 provides a switching signal to the gate 205 of the MEMS switching device 203. In general, the switching signal will be a voltage on the order of 40V. The switch controller 204 may include a charge pump to increase the level of the switching signal to the appropriate charge level for the MEMS switching device 203. The switching signal causes the cantilevered beam 206 of the MEMS switching device 203 to bend and come into contact with the gate 205.

During operation of the MEMS switching system, charge due to parasitic capacitance 207A, 207B on the signal path builds up on the input side and on the output side of the MEMS switching device 203 creating a voltage differential between the input and the output. In order to avoid a large current from flowing through the MEMS switching device during a change in state due to the charge imbalance at the input and output of the MEMS switching device 203, a balancing module 208 is included. The balancing module may, in its simplest form, be a pair of N-MOS switches that are provided with a control signal 209 at their gates. Thus, when the control signal activates the N-MOS switches a low resistance signal path is created, allowing a rebalancing of the charge at the input and the output of the MEMS switching device. By rebalancing the charge and removing the charge differential, a current will not be generated as the beam of the MEMS switching device closes or opens.

In addition to the charge build-up due to parasitic capacitance, changing states of the MEMS switching device while a signal is actively transmitted ("hot switching") can result in damage or failure of the MEMS switching device 203. In order to avoid hot switching, the MEMS switching system includes circuitry to prevent the simultaneous transmission of a data signal 210 and a state-change signal 211. When the outside processor issues the state-change signal 211 to the MEMS system, the state-change signal 211 is directed to the switch controller 204 of the MEMS system. The switch controller 204 sends an inhibit signal 212 to the signal driver 201 when the switch controller 204 receives the change state signal 211. The signal driver 201, which includes inhibit circuitry, receives the inhibit signal 212 and switches the signal driver 201 into a high impedance mode. Thus, the signal driver 201 can not pass the data signal 210 to the MEMS switching device 203. While the signal driver 201 is in the high impedance mode, the switch controller 204 either causes a large voltage to appear at the gate 205 of the MEMS switching device or removes the voltage from the gate causing the MEMS switching device to close or open, respectively. This may be accomplished with a charge pump or booster circuit as are known in the art. Once the switch has changed states, the switch controller stops transmission of the inhibit signal, and the signal driver continues to transmit the data signal. In certain embodiments, the driver 201 includes circuitry to sense the presence of a data signal, such as, edge detectors. When a data signal is sensed by the signal driver, the driver issues a data transmit signal to the switch controller, which prevents the switch controller 204 from changing the state of the MEMS switching device 203. When the signal driver 201 no longer senses the data signal, the signal driver ceases sending the data transmit signal 212 to the switch controller 204, and the switch controller 204 can then change the state of the switch 203 in response to a state-change signal from an outside processor.

Figure 3:
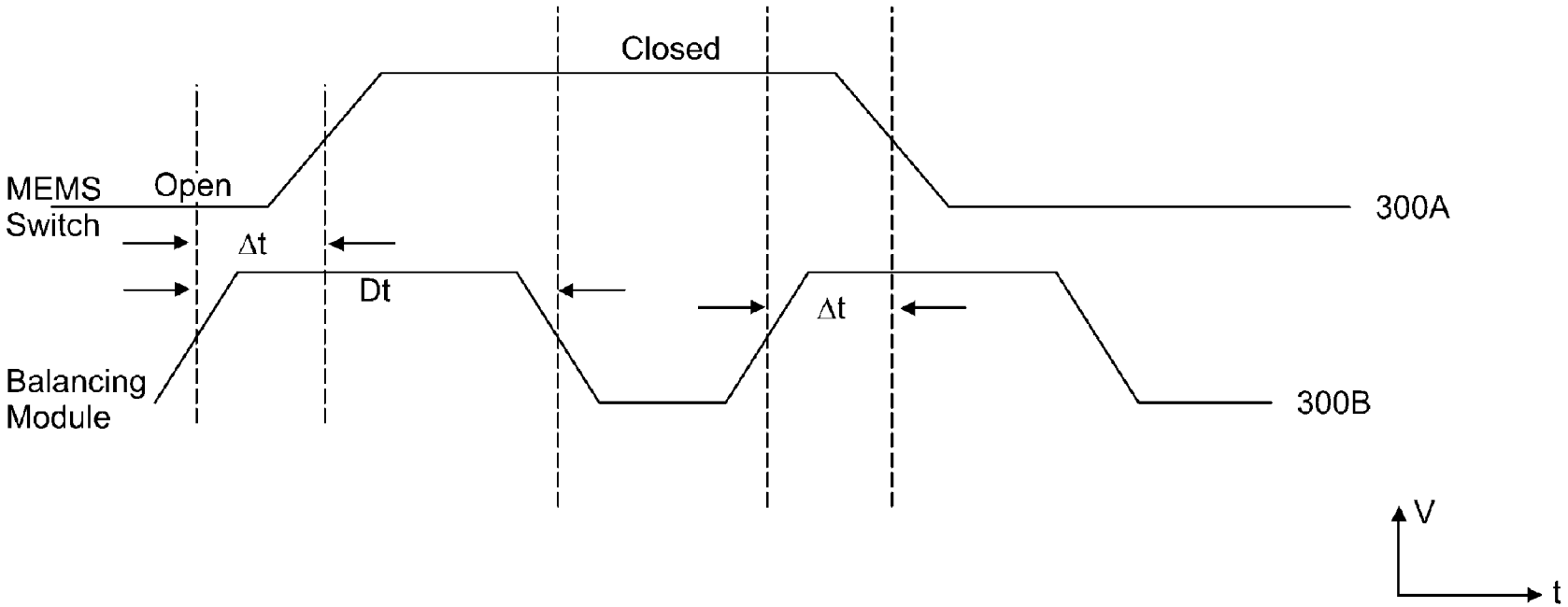
FIG. 3 shows timing diagrams for application of a voltage to the gate of the MEMS switching device and the voltage applied to the gate of both the MEMS switch device and the balancing module.
Figure 4:
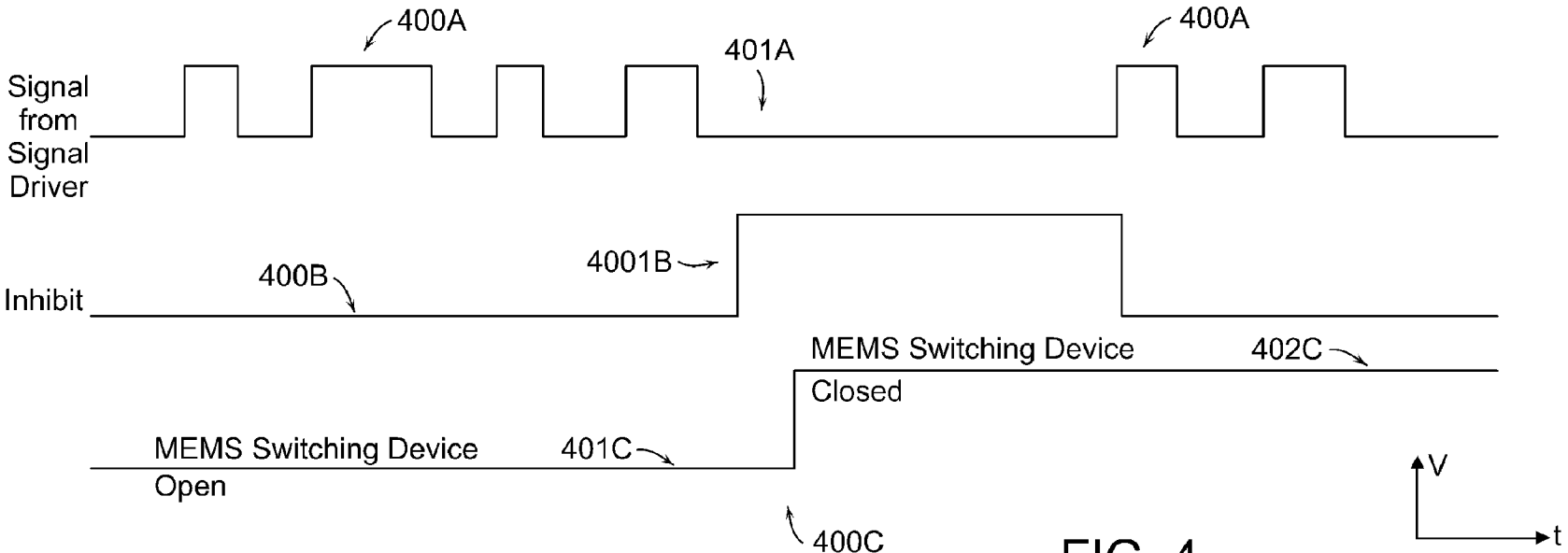
FIG. 4 shows a timing diagram used for preventing hot switching by inhibiting a signal driver.
Figure 5:
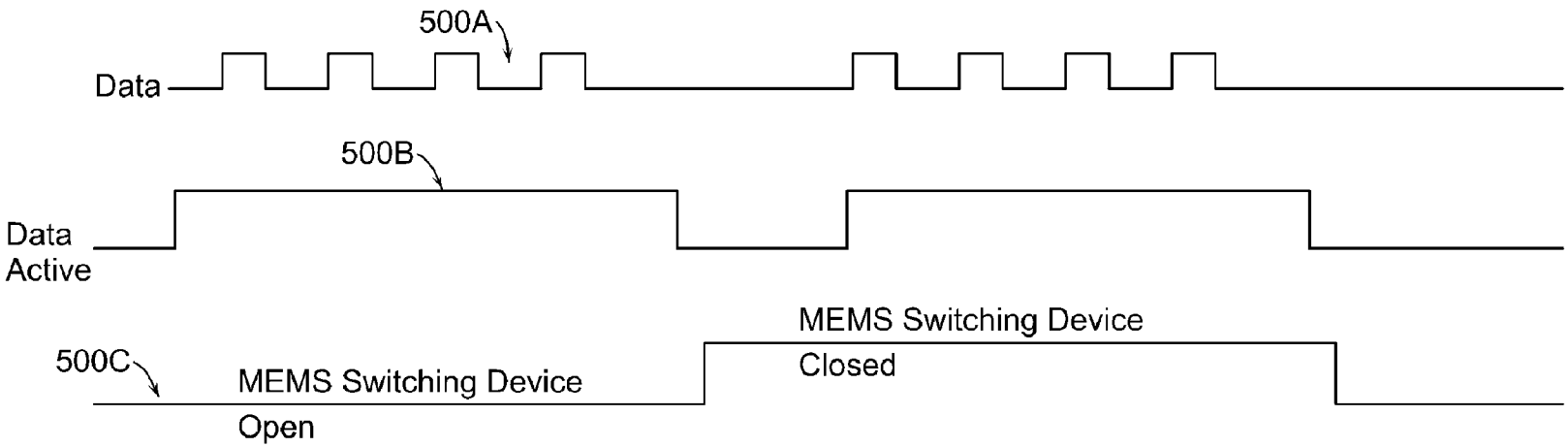
FIG. 5 shows a timing diagram used when the signal driver controls switching to prevent hot switching.

Preferably the balancing circuit and the hot-switching circuitry are included in the same MEMS switching system. As such, the charge caused by the parasitic capacitance is balanced by the balancing module and the signal driver is inhibited so that current does not flow through the MEMS switching device as the electrically conductive portion of the underside of the cantilevered beam becomes proximate with the first and second signal paths. In such an embodiment, the switch controller causes an inhibit signal and a control signal for activation of the balancing module. In certain embodiments, the inhibit signal may be the control signal for the balancing module. Provided below in FIGS. 3-5 are examples of timing diagrams for both the balancing module and the inhibit circuitry. It should be clear that these timing diagrams are exemplary only and the only requirements for timing are that the timing is arranged such that the signal driving device is off when the switch is making or breaking contact and that the balancing module is active long enough to allow for balancing of the parasitic capacitance between the input and output of the MEMS switching device. The timing as shown in FIGS. 3-5 takes into account both mechanical and signaling delays. These mechanical and signal delays will depend on the implementation and IC processes used to construct the MEMS switching system.

FIG. 3 shows timing diagrams for application of a voltage to the gate of the MEMS switching device 300A and the voltage applied to the gate of the balancing module 300B. As shown, the voltage to the gate of the balancing module is enabled prior to the voltage that causes the MEMS switching device to begin changing states by delta t. The MEMS switching device completes changing states at a time equal to or after the period of the enablement/disablement signal for the balancing module Dt. Thus, the balancing module is active for a period Dt that ends at or before the MEMS switching device has transitioned from either a closed to an open state or an open to a closed state. During the period Dt, the balancing module balances the charge differential caused by the parasitic capacitance and the period Dt is preferably equal to the RC time constant for allowing the charge to rebalance itself. In other embodiments, the period may be shorter wherein the charge differential between the input and the output of the MEMS switching device is substantially reduced. In such an embodiment, since the charge differential is reduced, but not balanced, the charge differential would generate a small current. However, the circuitry could be designed such that the small current would have only a slight effect on the life span of the MEMS switching device. Thus, in this embodiment, the balancing module would improve the life of the MEMS switching device, although not maximally.

FIG. 4 shows a timing diagram used for preventing hot switching wherein the switch controller inhibits the signal driver. The switch controller issues an inhibit signal 400B to the signal driver when the switch controller receives a state-change signal from an external source, such as a processor, for changing the state of the MEMS switching device. As shown, the inhibit signal transitions from low to high 401B. The inhibit signal causes the signal driver to enter into a high impedance mode and therefore, the data signal 400A does not reach the input of the MEMS switching device and no signal 401A is transmitted. After the switch controller provides the inhibit signal to the signal driver, the switch controller either provides or stops providing a voltage to the gate of the MEMS switching device. As shown, the MEMS switching device switches from an open state 401C to a closed state 402C and the switch controller provides a voltage to the gate of the MEMS switching device. Once the MEMS switching device fully closes, the switch controller stops transmission of the inhibit signal and the signal driver outputs the data signal. If the MEMS switching device is closed 402C, the data signal passes through the MEMS switching device to a subsequent stage. In an ideal situation, the inhibit signal and the voltage signal could be issued simultaneously by the switch controller. Practically, the voltage signal is issued after the inhibit signal allowing the signal driver to switch into a high impedance mode. In certain embodiments, the external state-change signal from the processor can be used to create the inhibit signal and also a signal to the balancing module for charge balancing.

FIG. 5 shows a timing diagram used when the signal driver controls the switch controller. Thus, in such an embodiment, the driver issues a data transmit signal 500B to the switch controller when a data signal 500A is present. As a result, the switch controller can not send a switching signal 500C to change the state of the MEMS switching device while receiving the data transmit signal 500B from the driver. This technique is especially appropriate to situations in which a user has control over the data signal. For example, this methodology may be appropriate in an automatic testing equipment environment in which devices under test are being tested. In such an environment, the tester controls the testing signals and may want to change tests and switch between a driver and a load of the pin electronics circuitry. MEMS switching devices within the pin electronics would allow for switching between the driver and the load. However, a transition between tests should not occur until the data sequence has been completely transmitted.

Figure 6:
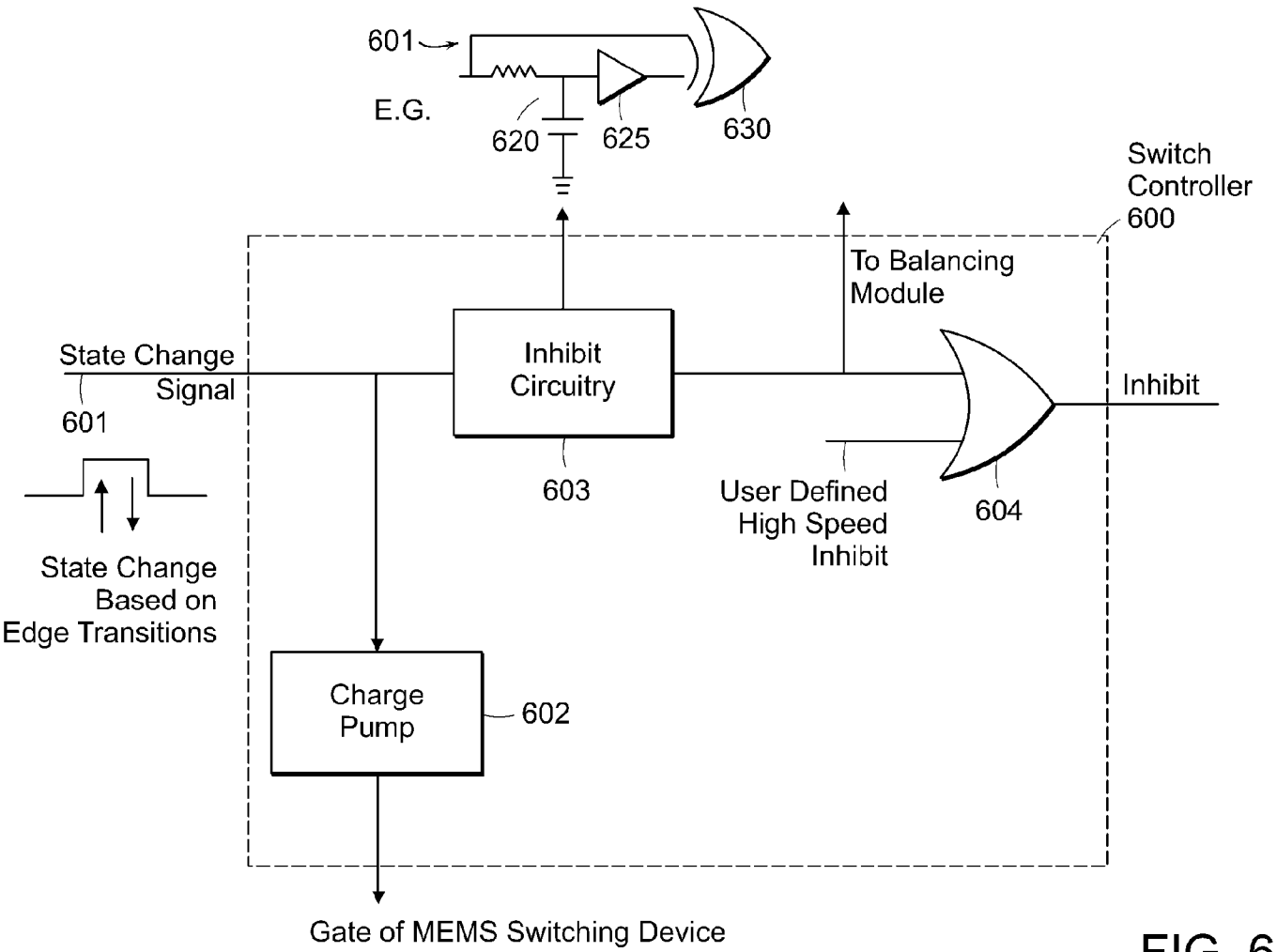
FIG. 6 shows a schematic of an inhibit module.

An embodiment of the switch controller is shown in FIG. 6. The switch controller 600 can provide automatic inhibit signal generation when a state-change signal is received. In order to indicate a desired transition in the state of the MEMS switching device, the state-change signal 601 transitions between a low-to-high state or a high-to-low state and as a result, a voltage is presented to the input of the switch controller. The state-change signal 601 is split and passed to the charge pump 602 and also to the inhibit circuitry 603. The inhibit circuitry 603 generates a pulse for a predetermined amount of time, for example 50 micro seconds. The pulse generation can be performed by any circuitry that can produce a pulse for a predetermined amount of time. This predetermined amount of time is determined in part by the time period for fully closing the MEMS switching device. An example of a pulse generator is shown as an example in FIG. 6. The state-change signal is input into the inhibit circuitry and split wherein the first part of the split state-change signal flows into an RC circuit 620 and the second part of the state-change signal flows into an input of an XOR gate 630. As the state-change signal flows into the RC circuit 620, the capacitor charges and eventually passes the signal to the driver 625 when the capacitor is fully charged. The driver 625 drives the signal into the second input of the XOR gate 630. The RC circuit is sized so that the RC time constant for substantially charging the capacitor is at least equal to the time to close the MEMS signaling device. The XOR gate 630 will output a logical one while the capacitor is charging and a logical zero after the capacitor is charged. Thus, the output of the XOR gate 630 will be a high signal when a switch transition is desired and will remain high for the predetermined period. The output of the inhibit circuitry is presented to an OR gate 604 and the OR gate 604 provides the inhibit signal to the signal driver (not shown). In addition, the output of the inhibit circuitry 603 can be provided to the balancing module for providing a control signal to the balancing module. As a result, the pre-determined time for the pulse generation may also be based on the time period that is necessary for balancing the charge due to the parasitic capacitance between the input and output sides of the MEMS switching device. Thus, the switch controller 600 causes the balancing module to balance the charge while inhibiting the signal driver preventing hot switching based solely on the state-change signal.

Additionally, the switch controller allows for generation of a user-defined inhibit signal to be sent to the signal driver. The user defined inhibit signal is presented to the input of an OR gate. As a result, if an inhibit signal is desired by the user, the inhibit signal provided to the OR gate guarantees that an inhibit signal will be generated regardless of the signal provided at the other input to the OR gate by the inhibit circuitry. The user defined inhibit signal can be a high speed signal wherein the automatically generated inhibit signal is generated at a relatively slower speed due to propagation through the circuitry.

Figure 7:
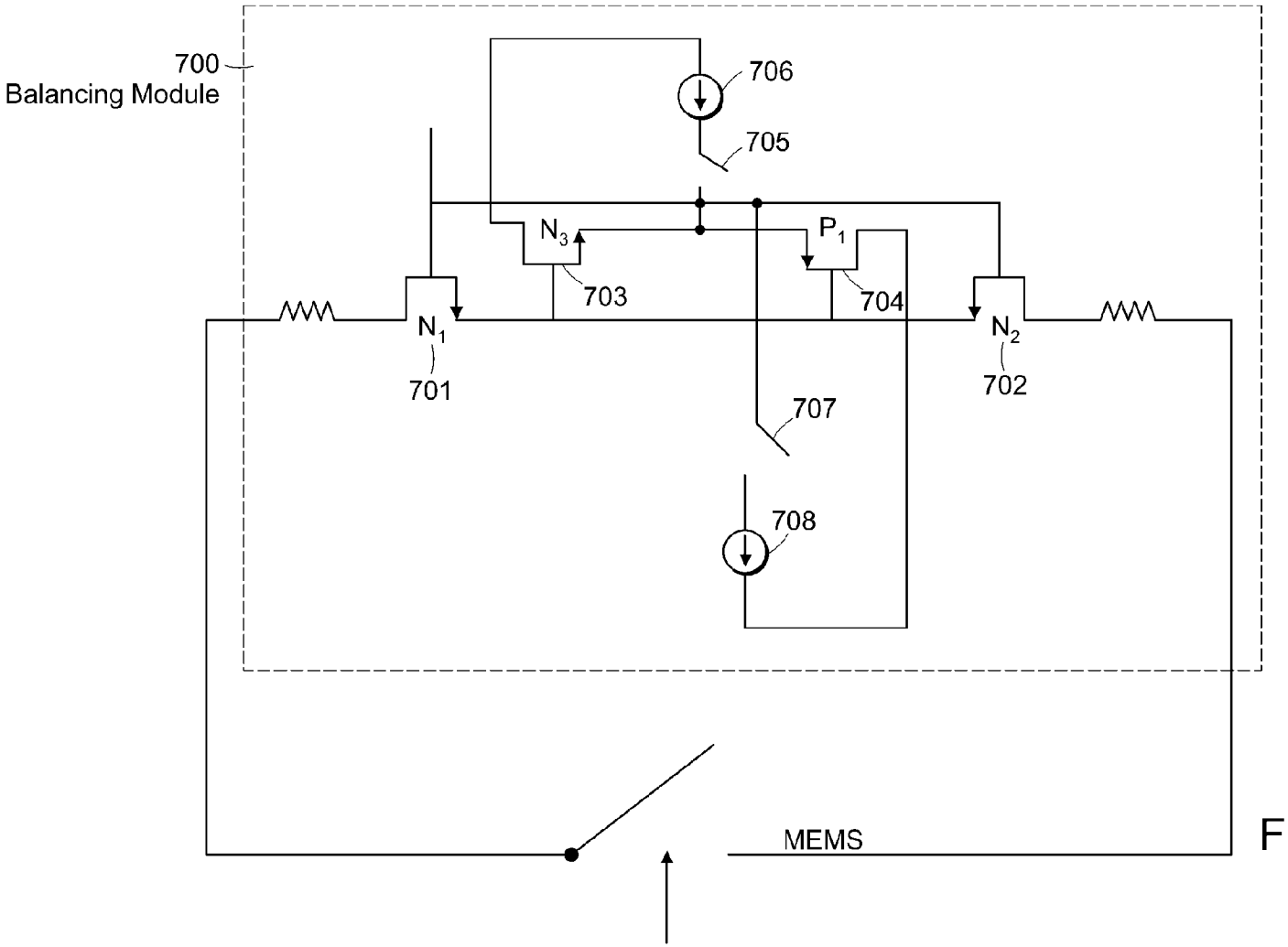
FIG. 7 show a circuit schematic of a balancing module implemented in DMOS.

The balancing module 700 can be implemented in DMOS as shown in FIG. 7. By using DMOS circuitry, the balancing module exhibits bi-directional charge flow when the upper switch 705 is activated allowing current to flow as the result of current source 706. In the shown embodiment, a signal is provided to the top current switch 705 while the bottom switch 707 is open. Transistors N1 and N2 (701, 702) are turned on due to transistors N3 and P1 (703, 704) providing sufficient Vgs for transistors N1 and N2 (701,702). The balancing module is in an off state when the top current switch 705 is open while the bottom switch 708 is closed and current source 708 generates a current. The gates of transistors N1 and N2 are pulled low turning off N1 and N2. Thus, the voltage node between the sources of transistors N1 and N2 floats. Since the voltage node floats, neither N1 nor N2 will inadvertently turn on. Thus, the balancing module exhibits a true "off" state.

Although various exemplary embodiments of the invention are disclosed below, it should be apparent to those skilled in the art that various changes and modifications can be made that will achieve some of the advantages of the invention without departing from the true scope of the invention.

What is claimed is:

1. A method for controlling a switching system including a micro-machined switching device, the method comprising:

sending a control signal to a balancing module;

in response to receiving the control signal at the balancing module, substantially reducing an electrical property between an input and an output of the micro-machined switching device;

stopping the control signal after the electrical property has been substantially reduced; and after substantially reducing the electrical property, supplying a gate voltage to the micro-machined switching device causing the micro-machined switching device to change states.

2. The method according to claim 1, wherein the electrical property is charge.

3. The method according to claim 1, wherein the electrical property is potential.

4. The method according to claim 1, wherein the balancing module includes a solid-state switch.

5. The method according to claim 1, further comprising:

after the micro-machined switching device has changed states, providing an input signal to the input of the micro-machined switching device.

6. The method according to claim 1, wherein the balancing module and the micro-machined switching device are connected in parallel.

7. A switching system comprising:

a micro-machined switching device having an input and an output;

a signal driver coupled to the input of the micro-machined switching device and configured to produce an input signal and to generate at least one control signal; and a balancing module having a control input and configured to, when activated by the control input, substantially equalize an electrical property between the input and the output of the micro-machined switching device;

wherein the signal driver is configured to:

a) provide the control signal to the control input of the balancing module, thereby causing the balancing module to substantially equalize the electrical property between the input and output of the micro-machined switching device;

b) subsequent to the balancing module substantially equalizing the electrical property, cause the micro-machined switching device to change states; and c) subsequent to the signal driver causing the micro-machined switching device to change states, provide the input signal to the input of the micro-machined switch.

8. The switching system according to claim 7, wherein the electrical property is charge caused by parasitic capacitance.

9. The switching system according to claim 8, wherein the balancing module includes a switch configured to operate, in response to the control signal, in a first state to cause charge due to the parasitic capacitance on the input and the output of the micro-machined switching device to substantially balance and to operate, absent the control signal, in a second state, in which parasitic capacitance can separately accumulate at the input and the output.

10. The switching system according to claim 9, wherein the balancing module comprises bi-directional DMOS circuitry.

11. The switching system according to claim 8, wherein the electrical property is electric potential.

12. A method for controlling a switching system including a micro-machined switching device, the method comprising:

generating an inhibit signal by a signal driver prior to the generation of an input signal;

sending the inhibit signal to a switch controller inhibiting the switch controller from supplying a gate voltage to the micro-machined switching device;

sending the inhibit signal to a balancing module;

in response to receiving the inhibit signal at the balancing module, substantially causing charge equalization through the balancing module between an input and an output of the micro-machined switching device;

stopping the inhibit signal after the balancing module has substantially caused charge equalization;

after substantially causing the charge equalization, supplying a gate voltage through the switch controller to the micro-machined switching device causing the micro-machined switching device to change states; and generating the input signal by the signal driver and providing the input signal to the micro-machined switching device.

13. The method for controlling a switching system according to claim 12, wherein the inhibit signal has a predetermined period.

14. The method for controlling a switching system according to claim 12, wherein the inhibit signal is transmitted for a period allowing charge to be balanced between the input and the output of the micro-machined switching device.

15. A switching system, the system comprising:

a micro-machined switching device including a gate, a signal input and a signal output;

a balancing module electrically coupled to the signal input and the signal output of the micro-machined switching device; and a switch controller configured to provide a gate voltage to the micro-machined switch;

wherein the switch controller is configured to provide a signal to a signal driver causing the signal driver to inhibit driving a data signal to the signal input of the micro-machined switching device at least while the gate of the micro-machined switching device changes states and the switch controller is configured to provide a control signal to the balancing module to substantially balance charge due to parasitic capacitance between the signal input and the signal output of the micro-machined switching device prior to the switch controller providing the gate voltage to the micro-machined switch.

16. The switching system according to claim 15, wherein the signal provided to the signal driver is also the control signal provided to the balancing module.

17. The switching system according to claim 15, wherein the switch controller is configured to provide the control signal is to the balancing module at least while the gate of the micro-machined switching devices is changing states.

18. The switching system according to claim 15, wherein the micro-machined switching device, the switching controller, and the balancing module are formed from a common substrate.

19. The switching system according to claim 18, further comprising:

a signal driver electrically coupled to the micro-machined switching device and configured to drive a signal, wherein the signal driver is formed on the common substrate.

* * * * *

UNITED STATES PATENT AND TRADEMARK OFFICE

CERTIFICATE OF CORRECTION

PATENT NO. : 8,154,365 B2
APPLICATION NO. : 12/814750
DATED : April 10, 2012
INVENTOR(S) : Chan et al.

It is certified that error appears in the above-identified patent and that said Letters Patent is hereby corrected as shown below:

In Col. 8, line 67
replace "signal is to"
with --signal to--

Signed and Sealed this
Tenth Day of July, 2012

David J. Kappos

David J. Kappos
*Director of the United States Patent and Trademark Office*